US005125880A

United States Patent [19]

Peters

[11] Patent Number: 5,125,880

[45] Date of Patent: Jun. 30, 1992

[54] SKI SIMULATION EXERCISE APPARATUS

[75] Inventor: Julian D. Peters, East Sussex, England

[73] Assignee: Ski Jive Limited, Surrey, England

[21] Appl. No.: 721,432

[22] PCT Filed: Jan. 26, 1990

[86] PCT No.: PCT/GB90/00097

§ 371 Date: Jul. 26, 1991

§ 102(e) Date: Jul. 26, 1991

[87] PCT Pub. No.: WO90/08577

PCT Pub. Date: Aug. 9, 1990

[30] Foreign Application Priority Data

Jan. 26, 1989 [GB] United Kingdom ..... 8901709
Feb. 10, 1989 [GB] United Kingdom ..... 8903101

[51] Int. Cl.[5] ..... A63B 23/04

[52] U.S. Cl. ..... 482/68; 482/79; 482/146; 482/71

[58] Field of Search ..... 272/96, 97, 70, 70.3, 272/114, 146, 30, 55; 280/87.01, 87.02, 87.041

[56] References Cited

U.S. PATENT DOCUMENTS 2,829,892 4/1958 Ludwig .
3,630,540 12/1971 Smith .
3,833,215 9/1974 Isdith ..... 272/114
3,834,693 9/1974 Poppenberger .
3,995,852 12/1976 Mendelson ..... 272/114
4,181,319 1/1980 Hirbod ..... 272/70.3
4,505,477 3/1985 Wilkinson ..... 280/84.041
4,601,469 7/1986 Sasser, Jr. ..... 272/146
4,743,014 5/1988 Loane .
4,911,440 3/1990 Hyman et al. ..... 262/146

FOREIGN PATENT DOCUMENTS 2577814 8/1986 France .

*Primary Examiner*—Richard J. Apley
*Assistant Examiner*—Lynne Reichard
*Attorney, Agent, or Firm*—Oliff & Berridge

[57] ABSTRACT

Exercise apparatus comprising a support, arranged for supporting a standing person, and an axle including a guide roller, arranged for providing guided rolling support to the support, at least one wheel member and an axle support, wherein said apparatus further comprises an axle twisting member arranged to cause the axle to twist about a second axis, lying across a first axis disposed along the length of the axle, in response to rotation of the axle about the first axis, caused when the support is moved across the axle in guided rolling engagement with the guide roller.

21 Claims, 5 Drawing Sheets

SKI SIMULATION EXERCISE APPARATUS

The present invention relates to exercise apparatus. In particular, the present invention relates to exercise apparatus which simulates the movement and responses to muscular effort experienced by a skier, during alpine or downhill skiing.

Apparatus of the type to which the invention relates may be used in the training of aspirant shiers or by experienced shiers wishing to improve their skiing technique. A simple ski simulator, known as a "wobble" board, consists of a flat board secured on top of an inverted dome: with the latter presenting a convex hemi-sperical surface below the board. To use a wobble board, the board should be placed on the ground, with the flat surface presented upwardly and the convex surface in contact with the ground. The user should stant on the board and exercise by performing a twisting action, whilst attempting to remain balanced upon the board. Unfortunately, the technique required to carry out such a balancing and twisting act is quite dissimilar to that employed in alpine skiing. At present, the only alternatives to the wobble board are complex and sophisticated electronically controlled machines. Although these latter simulators are more faithful in their simulation of the responses of alpine skis, they are expensive, large and complex. Accordingly, these machines cannot be afforded by the majority of private citizens, they are not easily transported or stored and are often difficult to service and set up for use.

According to the present invention there is provided exercise apparatus comprising support means, arranged for supporting a standing person, and axle means including guide roller means, arranged for providing guided rolling support to the support means, at least one wheel member and an axle supporting means, wherein said apparatus further comprises axle twisting means arranged to cause the axle member to twist about a second axis, lying across a first axis disposed along the length of the axle member, in response to rotation of the axle member about the first axis, caused when the support means is moved across the axle member in guided rolling engagement with the guide roller means.

Apparatus in accordance with the invention will turn to the left or right when a person, standing on the support member located on the guide roller means with the axle member supported on a smooth surface, mimics the body movements required to cause alppine skis to so turn. Thus, use of the apparatus both encourages the use of correct turning techniques and exercises those parts of the body that are regularly used during alpine skiing. The overall effect of using the apparatus is to build strength where required and to allow a user to learn, or develop a corect skiing technique.

Apparatus in accordance with the present invention may also by used by an experienced skier, or ski racer during rehabilitation after an accident, in order to keep in practice ane to generally strengthen damaged muscles and the like.

A further advantage of the present invention is that, in addition to the foregoing, the apparatus also may be used to train a user to adopt a balanced stance on the suppport member, as the axle member moves from side to side with respect to the support member. This enhances the training effect that may be derived from the use of the present invention, because an ability to remain in dynamic balance over moving skis, is fundamental in downhill or alpine skiing.

In an embodiment, the wheel member is fixed for rotation with the axle member, the axle supporting means is combined with the axle twisting means and said combined means comprises a post, pivotally supported by ground engaging means, the axle member being journalled in the post for rotation about the first axis. Preferably, the guide roller means are located between the wheel member and the combined axle supporting and twisting means. This embodiment of the invention allows only restricted twisting of the axle member about the second axis and, accordingly, may be used to simulate the responses of alpine skis during high speed, downhill skiing. This embodiment is particularly useful to skiers training for speed skiing events, such as the "flying K."

In an alternative embodiment, the axle supporting means comprises at least one further wheel member journalled on the axle member, the second axis crosses the first axis substantially midway between the wheel members, and the axle twisting means comprises means for causing the further wheel member to rotate in the opposite sense to the axle member, when the latter is caused to rotate about the first axis, in response to movement of the support means across the axle means. Preferably, the axle twisting means comprises differential means arranged to cause the further wheel member to rotate equally and oppositely to the first wheel member. In this alternative embodiment, the axle is able to twist through a greater arc for a given degree of movement of the support member with respect to the axle member. Accordingly, this embodiment of the present invention allows more accurate simulation of a lower speed and tightly turning skiing action.

In a preferred form of the aforementioned alternative embodiment, a pivotal post is journalled to the axle member, about the location where the first and second axis cross, said pivotal post being pivotably engaged and supported in ground engaging means. The addition of the pivotal post and ground engaging means provides extra stability to the apparatus of the invention and, in particular, prevents the second axis from moving, substantially, with respect to the surface upon which the apparatus is being used.

In a further embodiment, the differential means comprises a driving wheel, fixed for rotation with the axle member and in driving engagement with a rotatable pinion, and a second driven wheel in driving engagement with said pinion, wherein the pinion, driven and driving wheels are arranged and supported such that rotation of the axle member, first wheel member and driving wheel about the first axis, causes an equal and opposite rotation of the driven wheel and the second wheel member. Preferably, the driving wheel and driven wheel comprise toothed bevelled gear wheels, each having the same number of gear teeth and the pinion comprises a toothed bevelled gear wheel having its teeth in meshing engagement with the teeth of both the driving and driven wheels.

More preferably, a collar is journalled on the axle member between the driven and driving wheels, which collar provides an anchor for a shaft supporting the pinion, and locating means are provided to prevent the shaft, collar and pinion from being rotated through a significant arc about the first axis, with respect to the support means. The locating means can include further roller means for engaging the support means and holding the latter in contact with the guide roller means.

In further alternative embodiment, the differential means comprises an annular driving surface, surrounding the post in a fixed relationship with the ground engaging means, engaged by first and second driven wheels, the first driven wheel being fixed to the axle member for rotation therewith and the second driven wheel being rotatably journalled on the axle member. Preferably, the driving surface is an annular toothed bevelled gear and the driven wheels are annular toothed bevelled gears arranged in meshing engagement with the driving gear.

In preferred embodiments, the support member comprises a frame, carrying at least one foot support member, the foot support member being supported by two substantially parallel frame members, each of which is in substantially non-slipping guided rolling engagement with a guide roller of the guide roller means. Preferably the guide rollers are of substantially the same effective sizes and, when rolled upon the guide rollers, the frame is prevented from twisting substantially, with respect to the axle member. The foot support members can be journalled to the frame members, for at least partial rotation.

Further preferred embodiments of the present invention are described in the claims, set out hereinafter.

A specific embodiment of an apparatus in accordance with the present invention will now be described, by way of example only and with reference to the following drawings.

Figure 1:
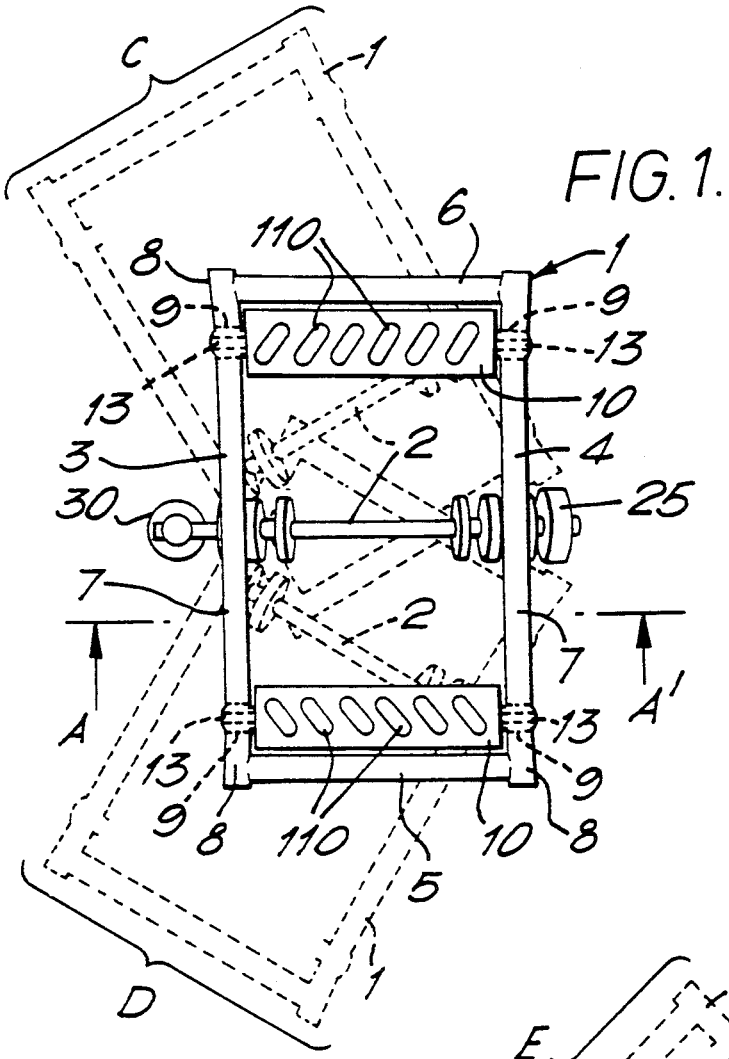
FIG. 1 is a plan view of the apparatus in a first form.

The apparatus shown in all the figures always comprises certain core, or essential components, in addition to a selection of optional or interchangeable components. The nature and location of these latter components is selected in order to adapt the apparatus into the chosen form. In the following description, wherever the same components are employed these components will be identified by the same reference numerals.

The essential or core components of the apparatus will now be described with reference to FIGS. 1, 2 and 3 of the drawings. The apparatus includes a frame 1, which is substantially rectangular in plan, resting on an axle assembly 2. The frame 1 comprises first and second parallel longer elongate members 3 and 4, and first and second parellel shorter elongate members 5 and 6, all formed from circular cross-sectioned steel tubing. Both end portions 8 of the longer members 3 and 4 are out of alignment with their straight middle portions 7. The shorter members 5 and 6 lie on a flat plane substantially parellel to and displaced from a flat plane, on which the straight middle portions 7 of both longer members 3 and 4 are located. The end portions 8 of the longer members 3 and 4 extend away from the middle portions 7, towards the plane on which the shorter members 5 and 6 lie. The shorter members 5 and 6 are joined at their ends to the end portions 8 of the longer members 3 and 4 by welding. When the frame is oriented as shown in FIG. 3, the shorter members 5 and 6 are raised above the middle portions 7 of the longer members 3 and 4.

Tubular bearing bushes 9 are brazed into the longer members 3 and 4, each bush 9 being located at the elbows formed where the end portions 8 turn out of alignment with the middle portions 7. The bushes 9 are of a smaller diameter than the longer members 3 and 4. The two bushes 9, adjacent to the shorter member 5, are disposed on an axis parellel to the shorter members 5 and 6 and the bushes 9, adjacent to the other shorter member 6, are disposed on a further axis parellel to the shorter members 5 and 6.

Foot rests 10 are located in the frame, adjacent to each of the shorter members 5 and 6. Each foot rest 10 (see FIG. 14) comprises a rectangular cross-sectioned elongate slab 50, having parellel, substantially rectangular and flat, upper 51 and lower 52 surfaces (as oriented in FIG. 14). Rectangular and parallel slab end faces 53 are orthogonal to and extend between the shorter sides or ends of the upper and lower surfaces 51 and 52. Inner 54 and outer 55 elongate side faces extend between the upper and lower surfaces 51 and 52 to complete the slab 50. The outer side face 55 is convex in appearance and the inner side face 54 is substantially flat. An extension 56 extends outwardly from the corner of the slab 50 defined by the junction of the inner side face 54 and the upper surface 51. The extension 56 extends along the length of the slab 50, has a hook shaped cross-section, provides a sideways extension to the upper surface 51 and defines a channel 35, between itself and the inner side face 54 of the slab 50. The channel 35 opens alongside the lower surface 52 of the slab 50 and the channel opening is approximately half as wide as the widest part of the channel 35. The foot rests 10 are conveniently cast in light alloy or a plastic material about a cylindrical steel rod extending parallel to the upper and lower surfaces 51 and 52, approximately midway between the inner and outer side faces 54 and 55. The rod extends lengthwise beyond the end faces 53, to provide two coaxial trunnions 13. The trunnions 13 of each foot rest 10 are journalled in each coaxial pair of bearing bushes 9 (see figure 1). The upper surfaces 52 of the foot rests 10 are provided with patches of high friction material 110.

Figure 14:
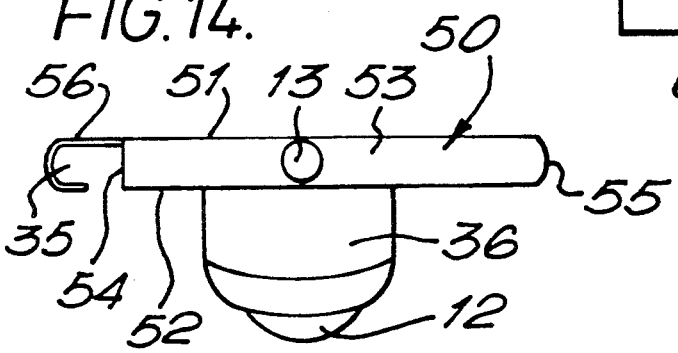
FIG. 14 is an end view of a first type of foot rest.

Two substantially cylindrical housings 36 are fixed by rivets (not shown) to the underside (as shown in figure 14) of the base 50. A steel ball bearing 12 protrudes partially from each housing 36 and is held in its respective housing 36 in such a way that it is free to roll in any direction.

A loop of elastically extensible cord 37 is engaged in the channels 35 of both foot rests 10 and wound around the axle assembly, between the foot rests 10, in a manner to be described. The cord 37 if sufficiently tight to hold the upper surfaces 52 of the foot rests 10 facing upwardly when the frame is orientated as shown in FIG. 3.

Figure 9:
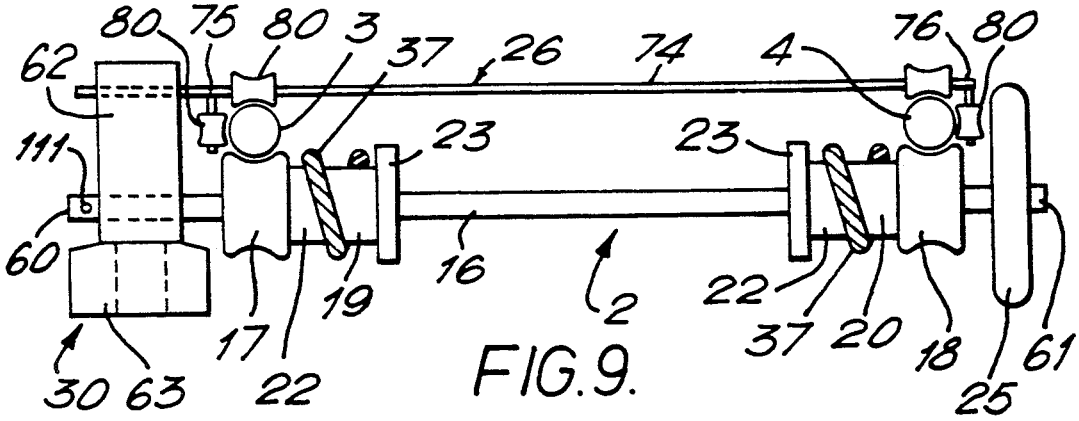
FIG. 9 is a section on the lines A—A' in FIG. 1.
Figure 10:
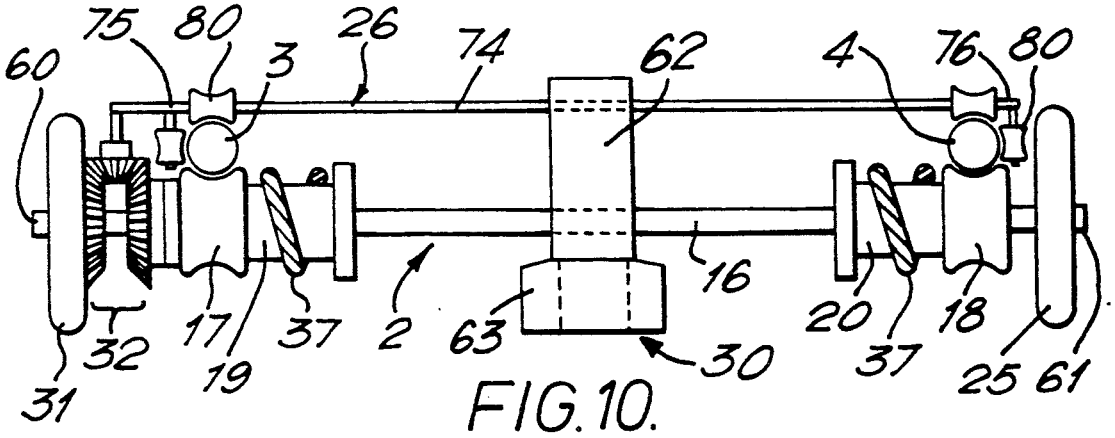
FIG. 10 is a section on the line B—B' in FIG. 2.
Figure 11:
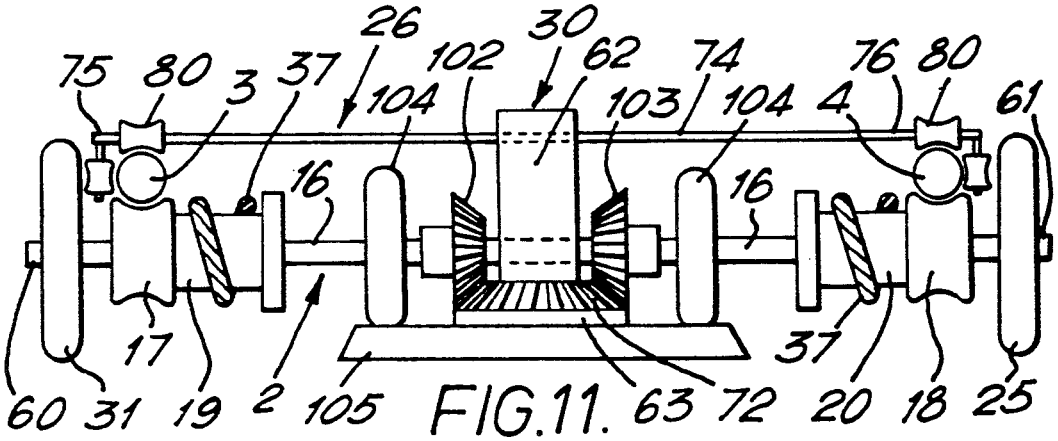
FIG. 11 is a sectional view of the apparatus in a fourth form.

The essential components of the axle assembly 2 are shown in detail in FIGS. 9–11 and, in part, in FIGS.

1-8. The axle assembly 2 comprises a rigid cylindrical axle bar 16, formed from steel, upon which first and second frame guide rollers 17 and 18, together with first and second cord guide rollers 19 and 20 are fixed to rotate with the axle bar 16. The cord guide rollers 19 and 20 are located between the frame guide rollers 17 and 18, which are spaced apart towards first and second end parts 60 and 61 of the bar. The frame guide rollers 17 and 18 are formed from a synthetic plastics or rubber material, capable of frictionally gripping the tubular members of the frame. The cord guide rollers 19 and 20 are formed from a similar material.

The frame guide rollers 17 and 18 are in the form of waisted cylinders, and the waist of each frame guide roller 16 and 17 is provided by an annular, U-sectioned channel 21 extending around the curved surface thereof. Each annular channel 21 is shaped and dimensioned so that a longer member 3 or 4 of the frame 1 may be located in rolling engagement therein. The spacing between the frame guide rollers is such that when the first longer member 3 is located in the annular channel 21 of the first frame guide roller 17, the second longer member 4 will locate in the annular channel 21 of the second frame guide roller 18.

The cord guide rollers 19 and 20 comprise smaller diameter cylindrical portions 22 and larger diameter cylindrical portions 23. Each of the cord guide rollers 19 and 20 abutts a frame guide roller 17 or 18, with its smaller portion 22 in contact with the adjacent frame guide roller 17 or 18. The smaller diameter portion 22 has a smaller diameter than the abutting portion of the adjacent frame guide roller 17 or 18. The arrangement provides a rectangular sectioned annular channel 24 around each of the cord guide rollers 19 and 20.

In the first, second and third forms of the apparatus, as shown in FIGS. 1-10, a first wheel 25, having a diameter greater than that of the frame guide rollers 17 and 18 and the cord guide rollers 19 and 20, is fixedly located on the second end portion 61 of the axle bar 16, adjacent to the second frame guide roller 18. The first wheel 25 is of conventional construction and is formed from a synthetic rubber material.

In all the illustrated four forms of the apparatus, the longer members 3 and 4 of the frame 1 are located in and, in use, supported by the frame guide rollers 17 and 18. In the first form of the apparatus, illustrated in FIGS. 1 and 9, the first end portion 60 of the bar 16, remote from the wheel 25, is supported by a pivot assembly 30. To convert the apparatus into the second form, the pivot assembly 30 is replaced by a second wheel 31 and a differential assembly 32 (see FIGS. 2 and 8). In addition to the wheel 31 and differential assembly 32 of the second form, the third form of the apparatus includes a pivot assembly 30, journalled on the bar 16 substantially midway between the wheels 25 and 31 (see FIG. 10).

The pivot assembly 30 (FIG. 12) comprises a steel post 62 journalled for rotation in a support or base 63 formed from a synthetic resin material. The post 62 comprises a cylindrical axle support 64 and a cylindrical spigot 65, formed as a coaxial extension of the axle support 64. Parallel upper and intermediate circular cross-sectioned passageways 66 and 67 extend diametrically through the axle support 64 and a lower circular cross-sectioned passageway 68 extends diametrically through the spigot 65, parallel to the upper and intermediate passageways 66 and 67. The pivot base 63 is outwardly substantially cylindrical, with a circular cross-sectioned bearing passage 69 extending axially therethrough.

Figure 12:
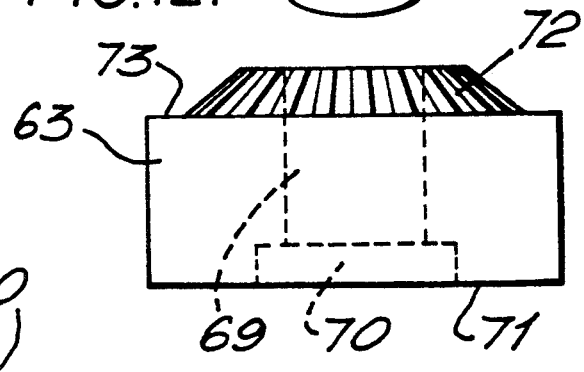
FIG. 12 is a side view of pivot components used in the first, third and fourth forms of the apparatus.

The bearing passage 69 is dimensioned so as to provide a journal for the spigot 65 to allow their relative rotation. The bearing passage 69 has a larger diameter portion 70 adjacent to the lower (in use and as shown in FIG. 12) annular face 71 of the base 63. When the spigot is inserted into the bearing passage 69, the lower passageway 68 is located within the larger diameter portion 70 of the bearing passage 69. A flat annular washer is inserted over the part of the spigot 65, which is lcoated within the larger diameter portion 70 of the bearing passage 69, and a split pin is pushed through the lower circular cross-sectioned passageway 68 and its ends are opened, in order to hold the post 62 and the base 63 together. In the fourth form of the apparatus only, the upper (in use and in FIG. 12) surface of the base 63 carries an annular bevelled gear 72. In all the other forms of the apparatus, the base has a flat annular upper surface 73.

In the first form of the apparatus the post 62 and base 63, of the pivot assembly 30, are assembled as aforesaid and the axle bar 16 is journalled for rotation in the intermediate passage 67 of the post 62 (see FIGS. 1 and 9). A split pin 111 is fitted in a passage extending diametrically through the part of the first end portion 60 of the bar 16, which protrudes from the post 62 and away from the remainder of the axle assembly 2. A bobbin bar 26 (see FIGS. 9 and 13) is tightly engaged in the upper passage 66 of the post 62. The bobbin bar 26 is not shown in FIG. 1 for clarity.

Figure 13:
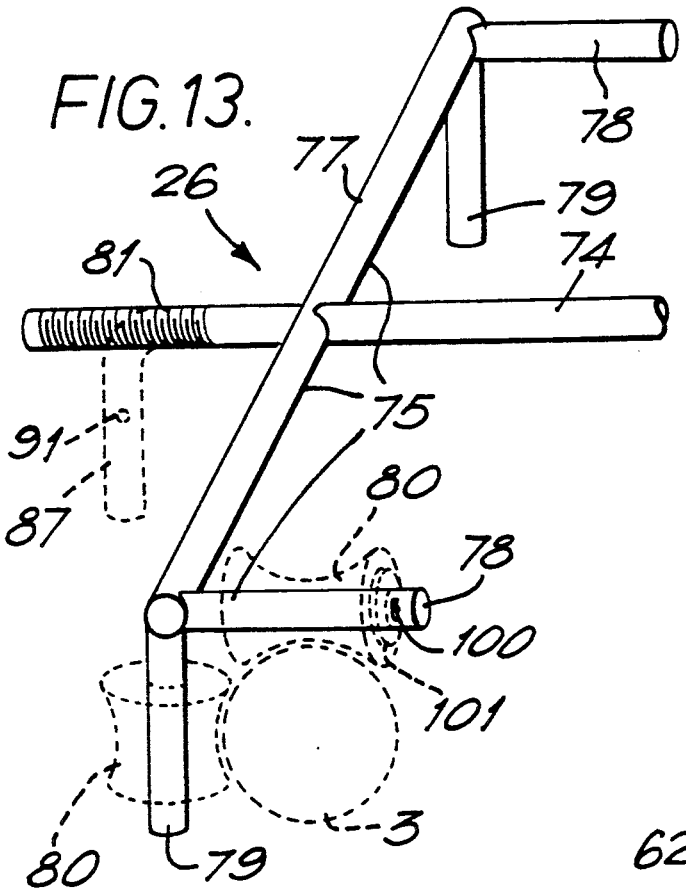
FIG. 13 is a side view of a portion of a bobbin bar.
Figure 13:
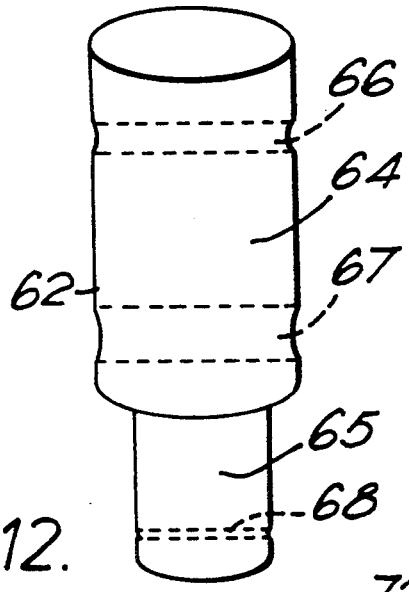

The bobbin bar 26 (see FIG. 13) is formed from lengths of steel rod, rigidly joined together by welding. A first rod 74 extends between first and second bobbin supporting trees 75 and 76. The first tree 75 is shown in FIG. 13 and the second tree 76, which is only shown in FIG. 9, is a mirror image of the first tree 75. FIG. 13 only shows a portion of the first rod 74. The tree 75 comprises a trunk rod 77, which extends orthogonally across the ajoining end of the first rod 74, and four branch rods 78 and 79. The branch rods 78 and 79 extend from the end parts of the trunk rod 77, which end parts are equidistant from the first rod 74. Branch rods 78 extend alongside and parallel to the first rod 74; whereas branch rods 79 both extend in the same direction, orthogonally to the trunk rod 77 and the branch rods 78. Wasted bobbins 80 are rotatably journalled on all of the branch rods 78 and 79, each bobbin 80 being held in place by a split pin 100 and washer 101 extending through the branch rods 78 and 79. A straight root rod 81 extends away from the first bobbin support tree 75, in a direction coaxial with the first rod 74. The root rod 81 is screw threaded.

The root rod 81 is engaged within the upper passage 66, in the post 62 of the bearing assembly 30 and rigidly fixed therein by threaded nuts (now shown), engaged upon the root rod 81, on either side of the post 62.

The wasted bobbins 80 are held by the bobbin bar 26 in rolling contact with the longer members 3 and 4 of the frame 1, as shown in FIG. 9 and in dashed lines in FIG. 13.

Two lengths of the cord 37 extend between the foot rests 10, both lengths being substantially parallel to the middle portions 7 of the longer frame members 3 and 4. Each length of the rope 37 is wound one turn around one of the cord guide rollers 19 or 20. The arrangement of the rope 37 is not shown in FIG. 1, however the arrangement is similar to that illustrated in FIGS. 3-5.

That is, the rope is arranged so that it spools onto and off the cord guide rollers 19 and 20 if the frame 1 is rolled across the axle assembly 2.

To use the first form of the apparatus, the base 63 of the pivot assembly 30 and the first wheel 25 should be placed on a smooth surface and the frame 1 should be engaged on the frame guide rollers 17 and 18, to be supported thereby. The wasted bobbins 80 should be in contact with the frame 1 as aforesaid. Such an arrangement is shown, in plan, in FIG. 1. The would be exerciser should stand upon the frame, located as shown in solid lines in FIG. 1, with one foot on each foot rest 10 and with his body facing towards the pivot assembly 30. When the exerciser pushes down upon his right foot the frame 1 rocks on the axle asesmbly 2 until the steel ball bearings 12, under the righthand foot rest 10, contact the supporting surface. Meanwhile the frame 1 will begin to roll across the axle assembly 2 and the latter will be caused to twist about the pivot assembly 30, until the frame 1 and axle assembly 2 adopt the position shown at C in FIG. 1. In this position, the frame 1 is shown in broken lines. If the user then should transfer his weight onto his left foot, the frame 1 will rock, and roll across the axle assembly 2 in the opposite direction, causing the axle assembly 2 to twist about the pivot assembly 30 in said opposite direction, until the frame 1 and axle assembly 2 adopts the position shown at D in FIG. 1. Again, in this position the frame 1 is shown in broken lines. With practice, an exerciser should be able to build up a rythm, swinging the frame 1 and axle assembly 2 rapidly between positions C and D, through the central position. As the user becomes further practiced, he will learn to balance the frame 1 on the axle assembly 2 throughout this procedure, so that little or none of his weight is supported on the ball bearings 12. When mimicing the actions of downhill or alpine skiing, the exerciser will cause the foot rests 10 to rotate, through movement of the trunnions 13 in the bearing bushes 9, in a similar way to that in which he would cause a ski on the outside of a turn to ride upon its inner edge. This rotation of a foot rest 10 increases the tension in the cord 37 and, thus, the axle 2 is pulled towards a direction, in which the user is attempting to cause it to twist.

As can be seen from FIG. 1, the angle through which the apparatus may twist about the pivot assembly 30, is restricted by the length of the middle portions 7 of the longer frame members 3 and 4. This restricted angle is intended to simulate fast downhill skiing.

The second form of the apparatus, shown in FIGS. 2, 4–6 and 8 includes a second wheel 31 and a differential assembly 32, located on the first end part 60 of the axle bar 16, in place of the pivot assembly 30 used in the first form. Furthermore, a modified form of bobbin bar 26 is employed.

Figure 8:
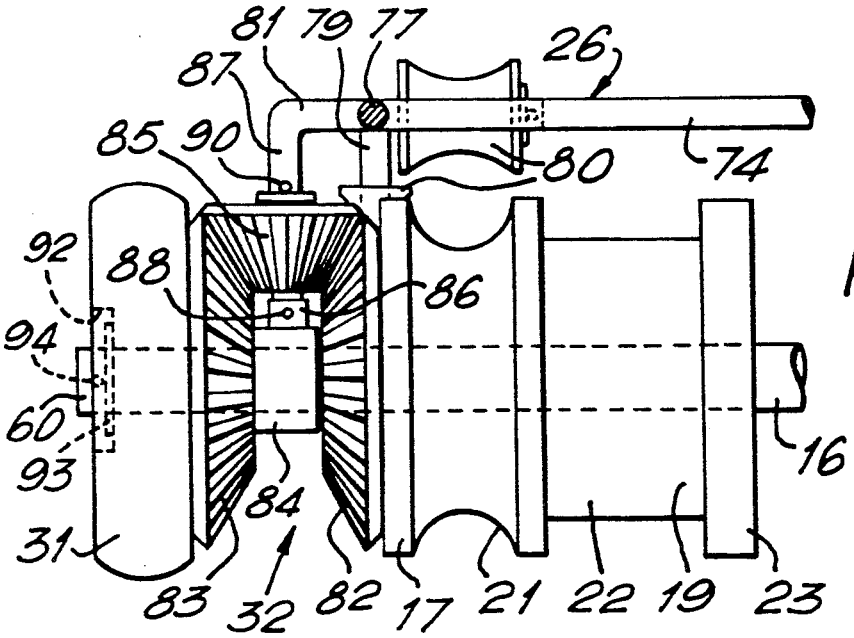
FIG. 8 is a detailed side view of a portion of the apparatus in the second form.

The differential assembly 32 and the adjacent components are shown in detail in FIG. 8. First and second annular bevelled gears 82 and 83, both having the same number of gear teeth, are located coaxially around the first end part 60 of the axle bar 16. The first bevelled gear 82 is rigidly fixed to the axle bar 16, in abuttment with the first frame guide roller 17. The bevelled gear 83 is journalled for rotation on the axle bar 16, spaced from the first bevelled gear 82 by an annular collar or sleeve 84, which is also journalled on the axle bar 16. The second bevelled gear 83 abutts and is in driving engagement with the second wheel 31, and is arranged with its toothed surface facing the toothed surface of the first bevelled gear 82. A bevelled pinion 85 is in meshing engagement with both the bevelled gears 82 and 83. A short annular collar 86 extends radially outwardly from the outer surface of the sleeve or collar 84.

The bobbin bar 26 is the same as that used in the first form of the apparatus, with the exception that, in the first tree 75, the root rod 81 is L-shaped, with a portion 87, remote from the trunk rod 77, extending in the same direction and parallel to the branch rods 79 (see FIG. 13). The remote root portion 87 is engaged within the annular collar 86 and fixed therein by a grub screw 88 threadably engaged through the side of the collar 86 (see FIG. 8). The pinion 85 is journalled for rotation on the remote root portion 87, between the annular collar 86 and a split pin 90 engaged in a passageway 91, which extends diametrically through the remote root portion 87. An annular recess 92 is formed about the first end 60 of the axle bar 16, in the face of the second wheel 31 on the opposite side thereof to the second bevelled gear 83. A flat annular washer 93 is located within the annular recess 92, and held in place by a split pin 94, which is engaged in a passage formed diametrically through the second end 61 of the axle bar 16. A curved cover member 96, shown only in FIGS. 2 and 5–7, extends in the manner of the mudguard over the differential assembly 32. The frame 1 is engaged on the frame guide rollers 17 and 18 and the longer members 3 and 4 are contacted by the wasted bobbins 80, in the manner shown in FIGS. 13 and 10 and as previously described. The cord 37 also is wound around the cord guide rollers 19 in the same manner as previously described.

When the second form of the apparatus is used, the wheels 31 and 25 should be placed on a smooth surface, with the frame 1 resting on the frame guide rollers 17 and 18. An exerciser should stand on the foot rests 10, facing towards the differential assembly 32. If the exerciser should then push on his right foot, starting from the position shown in solid lines in FIG. 2, the frame 1 will move across the axle assembly 2 and the engagement of the frame 1 with the frame guide rollers 17 and 18 will cause the axle assembly 2 to rotate. Since the frame 1 is prevented from rotating about the axle assembly 2, by the engagement of the ball bearings 12 with the surface supporting the apparatus; the engagement of the wasted bobbins 80 with the longer members 3 and 4, of the frame 1, prevent the remote root portion 87 of the bobbin bar 26 from rotating significantly about the axle bar 16. Accordingly, the pinon 85 cannot rotate significantly about the axle bar 16 and, thus, is driven in rotation about the remote root portion 87 by the first bevelled gear 82. The second bevelled gear 83 and hence the second wheel 31 are thereby driven in rotation by the pinion 85, in the opposite direction to the rotation of the bar 16. The effect of this is that, as the frame 1 is pulled across the axle assembly 2 and the latter rotates about an axis midway between its end parts 60 and 61 and the apparatus move into the position shown at E in FIG. 2. The motion is reversed if the exercised pushes out with his left foot and the frame 1 and axle assembly 2 will move into the position shown at F in FIG. 2. The frame 1 is shown in broken lines in positions E and F in FIG. 2.

As with the first form of the apparatus, the exerciser may build up a rythm, pushing first to the left and then to the right and may learn to balance the frame 1 over the axle assembly 2, such that little of his weight is transmitted through the ball bearings 12 to the supporting surface. The cord 37 will exert the same forces as described before, with reference to the first form of the apparatus, in response to the foot rests 10 being swivelled.

Figure 2:
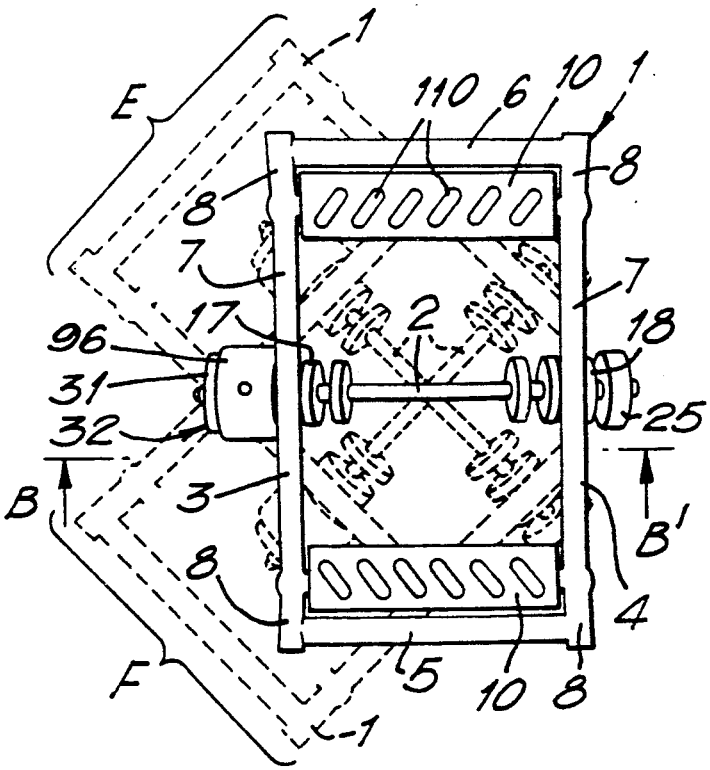
FIG. 2 is a plan view of the apparatus in a second form.
Figure 3:
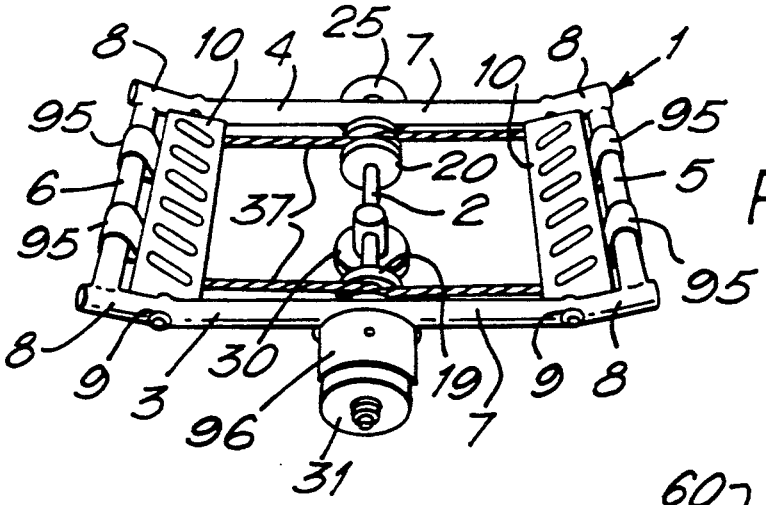
FIG. 3 is a perspective view of the apparatus in a third form.
Figure 4:
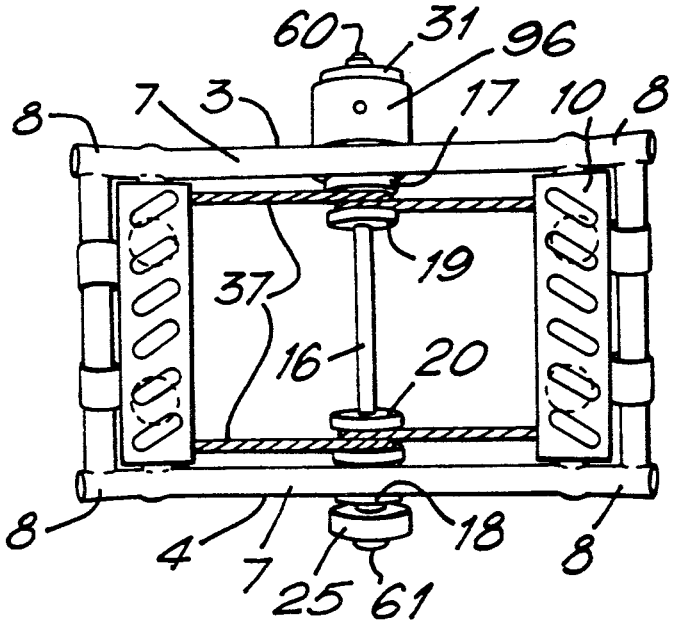
FIGS. 4–6 show the second form of the apparatus in first, second and third positions, respectively.
Figure 5:
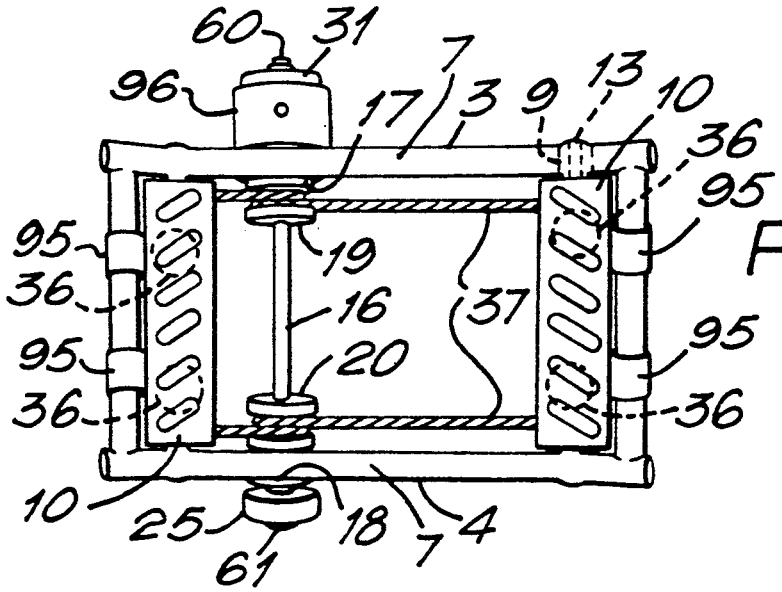
Figure 6:
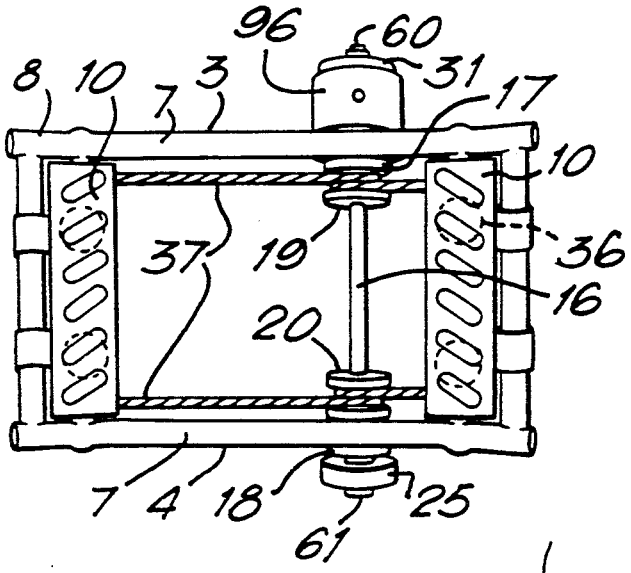
Figure 7:
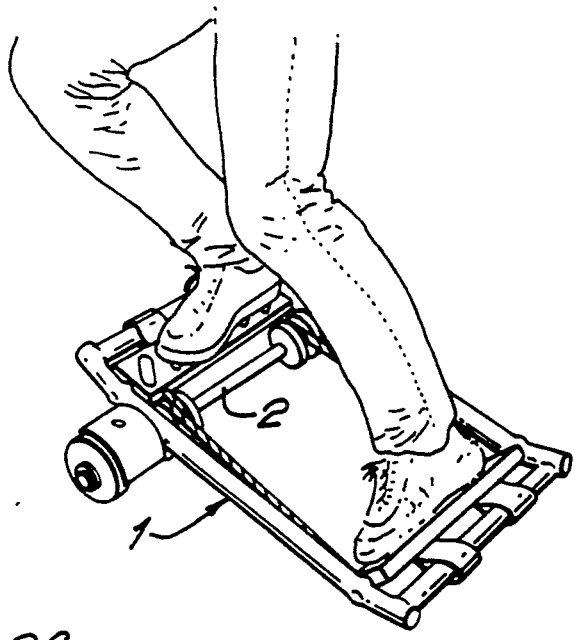
FIG. 7 shows the second form of the apparatus in use.

In FIG. 4 the apparatus is shown in the same position as shown in solid lines in FIG. 2. FIG. 5 shows the apparatus in positions E (in FIG. 2) whereas FIG. 6 shows the apparatus in positions F (in FIG. 2). For the sake of clarity, the bobbin bar 26 is not shown in any of FIGS. 2 and 4–7 and the cord 37 is not shown in FIG. 2. FIG. 7 shows the apparatus in use, showing the position adopted by a user's legs when the apparatus is in the position shown in FIG. 6.

Optionally, two loops of rubberised fabric webbing 95 extend around each of the shorter frame members 5 and 6 and are riveted to each foot rest 10. The purpose of the webbing 95 is to restrict the degree to which the foot rest 10 may be swivelled, with respect to the remainder of the frame 1.

The third form of the apparatus, shown in FIG. 3 and FIG. 10 is substantially the same as the second form of the apparatus, differing only by the provision of a pivot assembly 30, midway between the end parts 60 and 61 of the axle bar 16. The pivot assembly 30 is the same as that employed in the first form of the apparatus and described above. The axle bar 16 is journalled for rotation in the passage 67 in the post 62 and the first rod 74, of the bobbin bar 26, extends through the upper passage 66 in the post 62. In use, the base 63 of the pivot assembly 30 is engaged upon a supporting surface, which surface also supports the wheels 25 and 31. The third form of the apparatus is used in the same was as the second, with the post 62 rotating in the base 63 as the axle is swung around, as described above. The purpose of including a pivot assembly 30 is to provide extra stability to the apparatus.

In the fourth form of the apparatus, both the wheels 31 and 25 are journalled for rotation on the end portions 60 and 61 of the axle bar 16 (see FIG. 11). The bobbin bar 26 is formed as described above, except that there is no root portion 81. A pivot assembly 30 is journalled for rotation on the axle bar 16, midway between the end portions 60 and 61. The pivot assembly 30 is in the alternative form shown in FIG. 12, with the bevelled annular gear 72 formed around the bearing passage 69.

A first axle pinion 102 is fixed to the axle bar 16, so as to rotate therewith, and a second axle pinon 103 is journalled on the axle bar 16, for rotation relative thereto. Both axle pini0ns 102 and 103 have bevelled gear faces and are located in meshing engagement with the bevelled gear 72, on either side of the post 62. The axle bar 16 is journalled for rotation in the passage 67 in the post 62 and the first rod 74, of the bobbin bar 26, is rigidly engaged in the upper passage 66 of the post 62. A pair of inner guide wheels 104 are journalled for rotation on the axle bar 16. Each guide wheel 104 is located between one of the axle pinons 102 or 103 and the nearest of the cord guide rollers 19 or 20. Optionally, the inner guide wheel 104, adjacent to the fixed first axle pinion 102, may also be fixed for rotation with the axle bar 16. In this optional embodiment, the spacing between said inner guide wheel 104 and the first axle pinion 102 is chosen so that said inner guide wheel 104 will not skid along a supporting surface, as it is caused to turn by the axle bar 16. Optionally, the inner guide wheels may roll on a substantially flat circular track 105, placed between the base 63 of the pivot assembly 60 and the surface upon which the apparatus is supported. This fourth form of the apparatus is used in the same way as the third and second form. The axle assembly 2 being caused to pivot about the pivot assembly 30, as the frame 1 is pushed across the axle assembly 2, by the fixed axle pinion 102 being driven around the bevelled annular gear 72 by the rotation of the axle bar 16.

Claims

1. Exercise apparatus comprising support means, arranged for supporting a standing person, and axle means defining a first axis disposed along the length of said axle means and including guide roller means, arranged for providing guided rolling support to the support means as the support means is rolled over and across said axle means, at least one wheel member and an axle supporting means, wherein said apparatus further comprises axle twisting means arranged for causing the axle member to twist about a second axis, transverse to said first axis, in response to rotation of the axle member about the first axis.

2. Apparatus as claimed in claim 1 wherein the wheel member is fixed for rotation with the axle means, the axle supporting means is combined with the axle twisting means and said combined means comprises a post, pivotally supported by ground engaging means, the axle means being supported by the post for rotation about the first axis.

3. Apparatus as claimed in claim 2 wherein the guide roller means are located between the wheel member and the combined axle supporting and twisting means.

4. Exercise apparatus as claimed in claim 1 wherein the axle supporting means comprises at least one further wheel means journalled on the axle member, the second axis crosses the first axis substantially midway between the wheel members, and the axle twisting means comprises means for causing the further wheel member to rotate in the opposite sense to the axle means, when the latter is caused to rotate about the first axis by giuded rolling movement of the support means in the guide roller means.

5. Apparatus as claimed in claim 4 wherein the axle twisting means comprises differential means arranged to cause the further wheel member to rotate equally and oppositely to the first wheel member.

6. Exercise apparatus as claimed in claim 5 wherein a pivotable post is journalled to the axle means, about the location where the first and second axes cross, said pivotable post being pivotally engaged and supported in ground engaging means.

7. Apparatus as claimed in claim 5 wherein the differential means comprises a driving wheel, fixed for rotation with the axle means and in driving engagement with a rotatable pinion, and a second driven wheel in driven engagement with said pinion, wherein the pinion, driven and driving wheels are arranged and supported such that, rotation of the axle member, first wheel member and driving wheel about the first axis, causes an equal and opposite rotation of the driven wheel and the second wheel member.

8. Exercise apparatus as claimed in claim 7 wherein the driving wheel and driven wheel comprise toothed bevelled gear wheels, each having the same number of gear teeth, and the pinion comprises a toothed bevelled gear wheel having its teeth in meshing engagement with the teeth of both the driving and driven wheels.

9. Exercise apparatus as claimed in claim 6, wherein the differential means comprises an annular driving surface, surrounding the post in a fixed relationship with the ground engaging means, engaged by first and second driven wheels, the first driven wheel being fixed to the axle means for rotation therewith and the second driven wheel being rotatably journalled on the axle means.

10. Exercise apparatus as claimed in claim 9 wherein the driving surface is an annular toothed bevelled gear and the driven wheels are annular toothed bevelled gears arranged in meshing engagement with the driving gear.

11. Exercise apparatus as claimed in claim 2, further comprising means, attached to the post, for holding the support means in guided rolling contact with the guide roller means.

12. Exercise apparatus as claimed in claim 7 wherein a collar is journalled on the means between the driven and driving wheels, which collar provides an anchor for a shaft supporting the pinion, and locating means are provided to prevent the shaft, collar and pinion from being rotated through a significant arc about the first axis, with respect to the support means.

13. Exercise apparatus as claimed in claim 12 wherein the locating means includes further roller means for engaging the support means and holding the latter in contact with the guide roller means.

14. Exercise apparatus as claimed in claim 1 wherein the support member comprises a frame, carrying at least one foot support member, the foot support member being supported by two substantially parallel frame members, each of which is in substantially non-slipping guided rolling engagement with a guide roller of the guide roller means.

15. Exercise apparatus as claimed in claim 14 wherein the guide rollers are of substantially the same effective sizes and, when rolled upon guide rollers, the frame is prevented form twisting substantially with respect to the axle means.

16. Exercise apparatus as claimed in claim 14 wherein the frame comprises two foot support members in a spaced apart relationship, each foot support member extending between said frame members.

17. Exercise apparatus as claimed in claim 16 wherein the foot support members are journalled to the frame members for at least partial rotation.

18. Exercise apparatus as claimed in claim 15 wherein the foot support member or members are provided with bearing means arranged for allowing each foot support member to glide across a surface supporting the axle means, when the frame is caused to rock on the axle means.

19. Exercise apparatus as claimed in claim 18 wherein each of said bearing means comprises a ball bearing rotatably mounted in a housing secured to each foot support member.

20. Exercise apparatus as claimed in claim 16 wherein a cord guide roller is located on the axle means, for rotation therewith, and an elastic cord extends between the foot support members, the cord being wound, at least once, around the cord guide roller.

21. Exercise apparatus as claimed in claim 20 wherein a pair of cord guide rollers are located on the axle means and a second length of elastic cord extends between the foot support members, said second length of cord being wound, at least once, around the second cord guide roller.

* * * * *